US005622000A

United States Patent [19]

Marlowe

[11] Patent Number: 5,622,000

[45] Date of Patent: Apr. 22, 1997

[54] LASER SIGHTING SYSTEM FOR FIREARM FORE HANDGRIP ASSEMBLY

[76] Inventor: Ira M. Marlowe, 70 Hillside Ave., Cresskill, N.J. 07626

[21] Appl. No.: 526,219

[22] Filed: Sep. 11, 1995

[51] Int. Cl.[6] ..... F41G 1/34

[52] U.S. Cl. ..... 42/103; 42/100; 42/84; 42/102

[58] Field of Search ..... 42/103, 100, 84, 42/102; 362/114; 33/233; 89/142, 126

[56] References Cited

U.S. PATENT DOCUMENTS

| | | | |
|---|---|---|---|
| 2,597,565 | 5/1952 | Chandler et al. | 240/6.41 |
| 4,567,810 | 2/1986 | Preston | 89/142 |
| 4,934,086 | 6/1990 | Houde-Walter | 42/103 |
| 4,967,642 | 11/1990 | Mihaita | 89/126 |
| 5,048,215 | 9/1991 | Davis | 42/72 |
| 5,090,805 | 2/1992 | Stawarz | 356/251 |
| 5,179,235 | 1/1993 | Toole | 42/103 |
| 5,375,362 | 12/1994 | McGarry et al. | 42/103 |
| 5,435,091 | 7/1995 | Toole et al. | 42/103 |
| 5,481,819 | 1/1996 | Teetzel | 42/103 |
| 5,515,636 | 5/1996 | McGarry et al. | 42/103 |

*Primary Examiner*—Charles T. Jordan
*Assistant Examiner*—Meena Chelliah
*Attorney, Agent, or Firm*—Charles J. Brown

[57] ABSTRACT

A laser sighting system mounted entirely in a fore handgrip assembly of a firearm also having a pistol handgrip rearward of the fore handgrip assembly, the fore handgrip assembly including a frame removably secured relative to a barrel of the firearm and a hollow grip element extending from the frame transverse to the barrel axis, the laser sighting system including a battery inside the hollow grip element, a laser diode on the frame forward of the grip element connected by electrical circuitry to the battery and a switch on the grip element for selectively energizing the laser diode.

2 Claims, 3 Drawing Sheets

LASER SIGHTING SYSTEM FOR FIREARM FORE HANDGRIP ASSEMBLY

SUMMARY OF THE INVENTION

Laser sighting systems for firearms have been the subject of a considerable degree of technical development during the last decade. A wide variety of laser sighting devices has been disclosed not only in issued patents but throughout the technical literature as well. In virtually all of these systems a laser diode is mounted on a firearm to direct a laser beam substantially parallel to the axis of the firearm barrel toward an intended target. Electric battery means are commonly included somewhere in or on the firearm together with circuitry connecting the laser diode with the power source. An on-off switch is usually included for selectively energizing the laser diode.

Substantial retrofitting of the host firearm is typically necessary in conventional laser sighting systems. Thus the diode is often independently mounted on the forward end of the firearm adjacent the muzzle of the barrel, the electric battery means are housed or affixed elsewhere on the firearm and an on-off switch is located typically on or near a pistol grip of the firearm rearward of the trigger.

Some automatic and semi-automatic weapons include not only a pistol handgrip rearward of the trigger but also a detachable fore handgrip assembly forward of the trigger. An example of such a firearm is the model MP5K Personal Defense Weapon (or "PDW") manufactured by the Heckler & Koch Company of Sterling, Va. No known design of a laser sighting system has been specially configured to be mounted entirely within and on such a detachable fore handgrip assembly. It is a principal object of the present invention to provide a laser sighting system specifically confined to a detachable fore handgrip assembly so that it can be marketed and supplied to users of such weapons as an enhancement of the detachable component alone with no modification or retrofitting of any kind required of the remaining structure of the firearm.

Perhaps the most relevant prior art disclosure with respect to the subject matter of the present invention is in U.S. Pat. No. 2,597,565. It describes a firearm which includes a pistol handgrip transverse to the barrel axis rearward of the trigger and a detachable fore handgrip assembly forward of the trigger. That fore handgrip assembly is modified to include not a laser sighting system but rather simply a flashlight with its batteries enclosed in a conventional manner in a cylindrical body of the flashlight behind the bulb and reflector. An on-off button switch is provided on the grip element of the fore handgrip assembly.

It should also be noted that in the fitting of laser sighting devices to pistols it is well known to locate electric batteries in a chamber hollowed out within the pistol handgrip which is transverse to the barrel axis and rearward of the trigger. Examples of such a battery location for laser sighting devices on pistols are described in U.S. Pat. Nos. 5,179,235 and 4,934,086.

SUMMARY OF THE INVENTION

The invention provides a laser sighting system mounted entirely on a fore handgrip assembly of a firearm which includes a barrel having a longitudinal axis and a forward muzzle, a trigger, and a pistol handgrip transverse to the barrel axis rearward of the trigger. The fore handgrip assembly of this firearm is detachable and is located forward of the trigger. That assembly includes a frame removably secured relative to the barrel and a hollow grip element extending from the frame transverse to the barrel axis. The laser sighting system of the invention includes electric battery means removably located within the hollow grip element. A laser diode assembly is included which is mounted on the frame forward of the grip element for directing a laser beam alongside and at least substantially parallel to the barrel axis. Electrical circuit means are included in the grip element and frame connecting the battery means and the laser diode assembly. A switch is included on the grip element in the electrical circuit means for selectively energizing the laser diode assembly.

The electric battery means may be a direct current battery. The hollow grip element may have an opening at one end remote from the frame for insertion of the battery means. The laser diode assembly may comprise a laser diode element and an open-ended housing securable to the frame and encircling the diode element. The diode element may be secured to the frame by adjustment screw means permitting angular adjustment in the direction of the laser beam in relation to the barrel axis. The switch may be an on-off manually depressible button on a forward portion of a grip element adjacent the frame and rearward of the diode assembly.

DESCRIPTION OF PREFERRED EMBODIMENT

Figure 1:
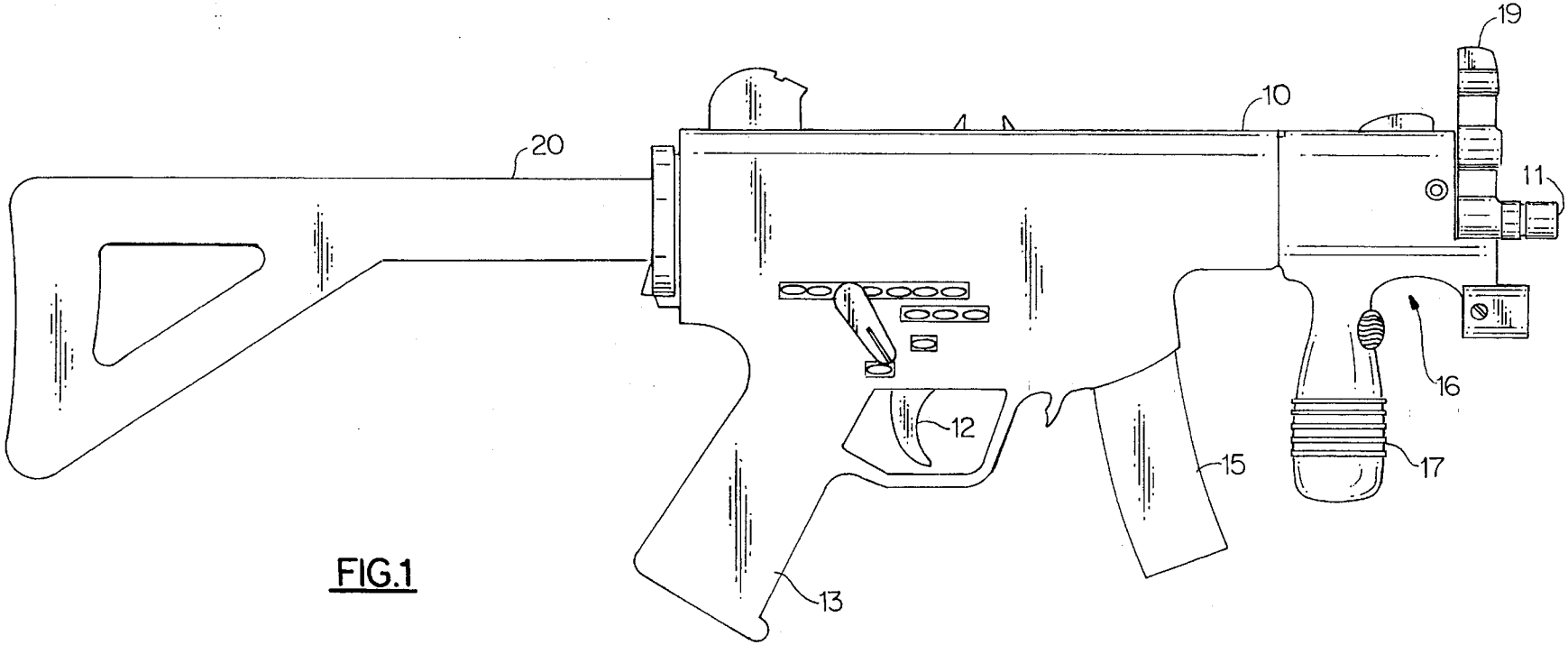
FIG. 1 is a longitudinal elevation of a Heckler & Koch MP5K-PDW firearm with its detachable fore handgrip assembly visible beneath the discharge end portion of the barrel of the firearm modified with the laser sighting system of the invention mounted entirely on that fore handgrip assembly.

The structure and mode of operation of the components of the Heckler & Koch MP5K-PDW firearm shown in FIG. 1 are, except for the detachable fore handgrip assembly, in all respects conventional and need not be described in detail. It is sufficient to note that such a firearm includes a barrel assembly 10 having a forward muzzle 11, a trigger 12 and pistol handgrip 13 transverse to the barrel axis. The "forward" end of this firearm as that term is used herein is the muzzle 11 of the barrel at the right in FIG. 1 and all components shown to the left of that are referred to as being relatively "rearward".

A firearm of this type uses 9 mm cartridges contained in a fifteen or thirty round magazine 15. It may fire in a semi-automatic or fully automatic mode. A detachable fore handgrip assembly 16 is fitted to the underside of the barrel assembly 10 rearward of the muzzle 11 of the barrel and forward of the magazine 15. This fore handgrip assembly 16 includes a grip element 17 extending transverse to the axis of the barrel. The barrel assembly includes a conventional cocking lever housing 18 located over and parallel to the barrel. A sight 19 is also located over the barrel adjacent its muzzle 11.

A retractable butt stock 20 is extendable from the rear of the firearm as shown in FIG. 1. In a typical firing position for a right handed operator the butt stock 20 is held against the shoulder, the right hand is closed about the pistol grip 13 with the forefinger on the trigger 12 and the left hand is closed about the grip element 17.

A principal object and advantage of the laser sighting system of the invention is that the entire system is mounted exclusively on the fore handgrip assembly 16. Therefore the only retrofitting or modification of the Heckler & Koch MP5K-PDW is to that assembly and nothing else. Since the fore handgrip assembly 16 is detachable it is particularly adapted when removed to the minor modifications required for installation of the laser sighting system of the invention. Those modifications are described in relation to FIGS. 2 to 4 hereof.

Figure 2:
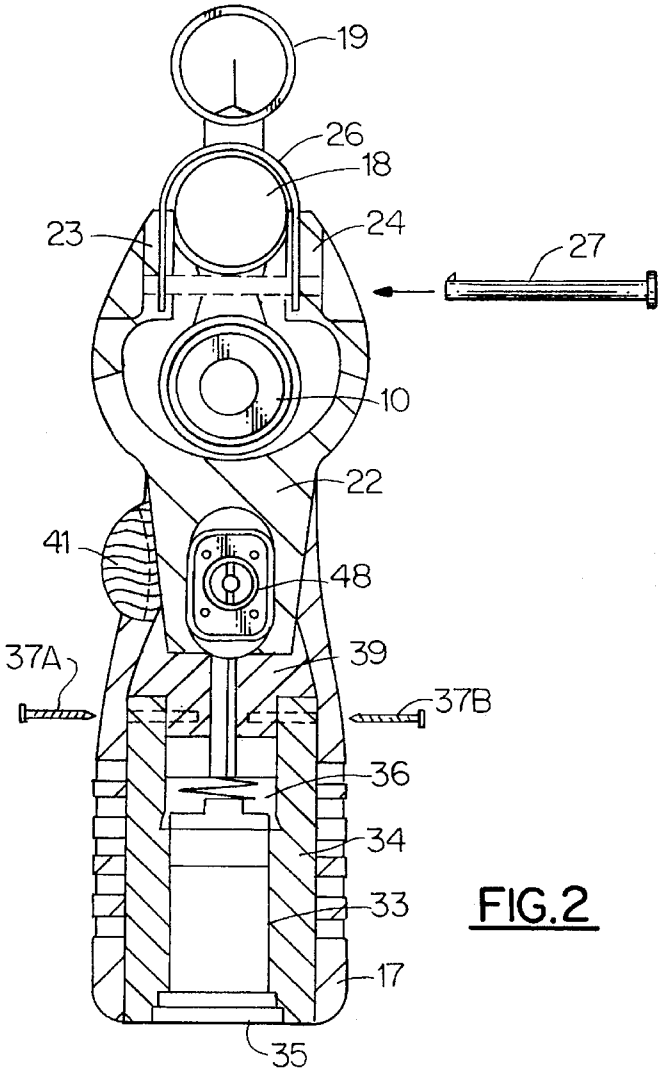
FIG. 2 is an end elevation partly in section of the forward end of the firearm of FIG. 1.

As shown in FIG. 2 the fore handgrip assembly 16 includes a frame 22 from which side-by-side ears 23 and 24 project upwardly to fit about the cocking lever housing 18 of the firearm. An inverted U-shaped retaining clip 26 is affixed over the cocking lever housing 18 with its ends between the ears 23 and 24. A removable pin 27 fits through holes in the ears 23 and 24 and through the ends of the clip 26 and a channel in the frame 22 to hold the fore handgrip assembly 16 in place.

Figure 3:
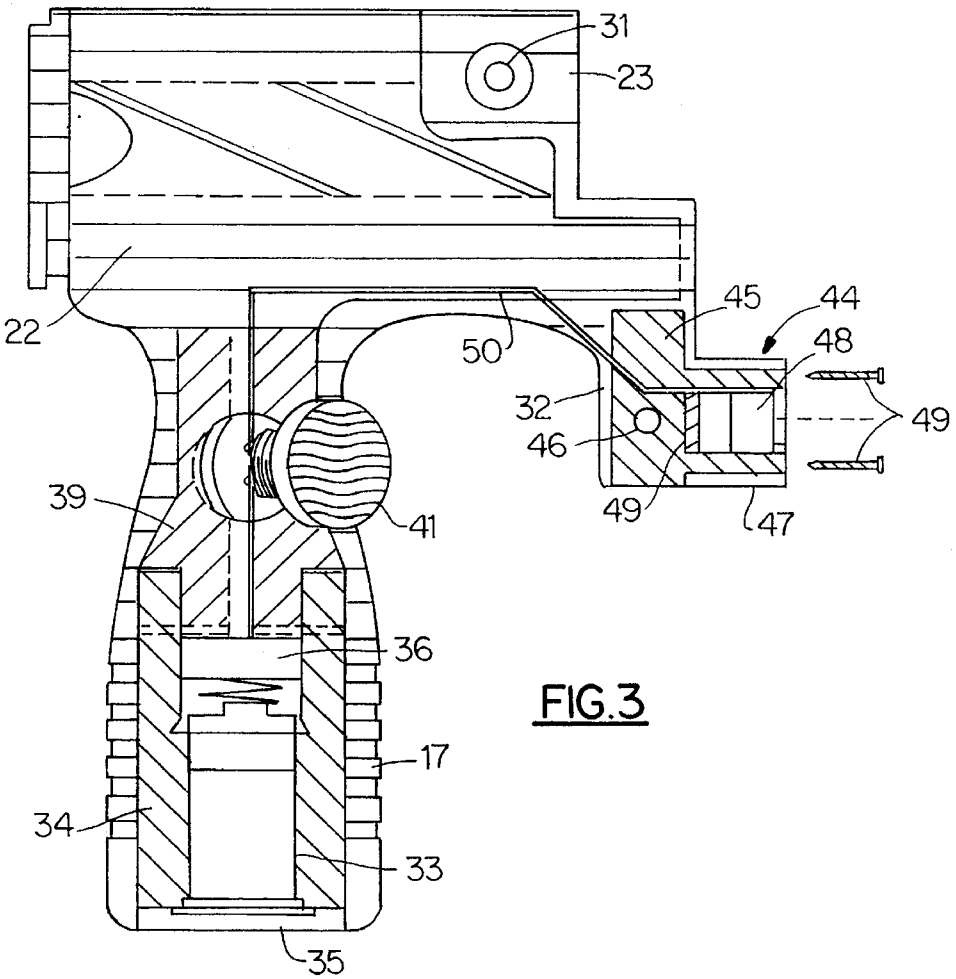
FIG. 3 is an enlarged elevation partly in section of the detachable fore handgrip assembly of the firearm of FIG. 1 with all components of the laser sighting system mounted entirely thereon.

In FIG. 3 the fore handgrip assembly 16 of the firearm is shown detached from the barrel 10. Thus a transverse hole 31 is visible in the ear 23 for receiving the pin 27. The grip element 17 extends downwardly from the frame 22 transverse to the barrel axis. It is conventional in the Heckler & Koch MP5K-PDW that a flange 32 projects downwardly transverse to the barrel axis forward of the grip element 17 to serve as a guard keeping the finger of the user away from the muzzle 11.

Figure 4:
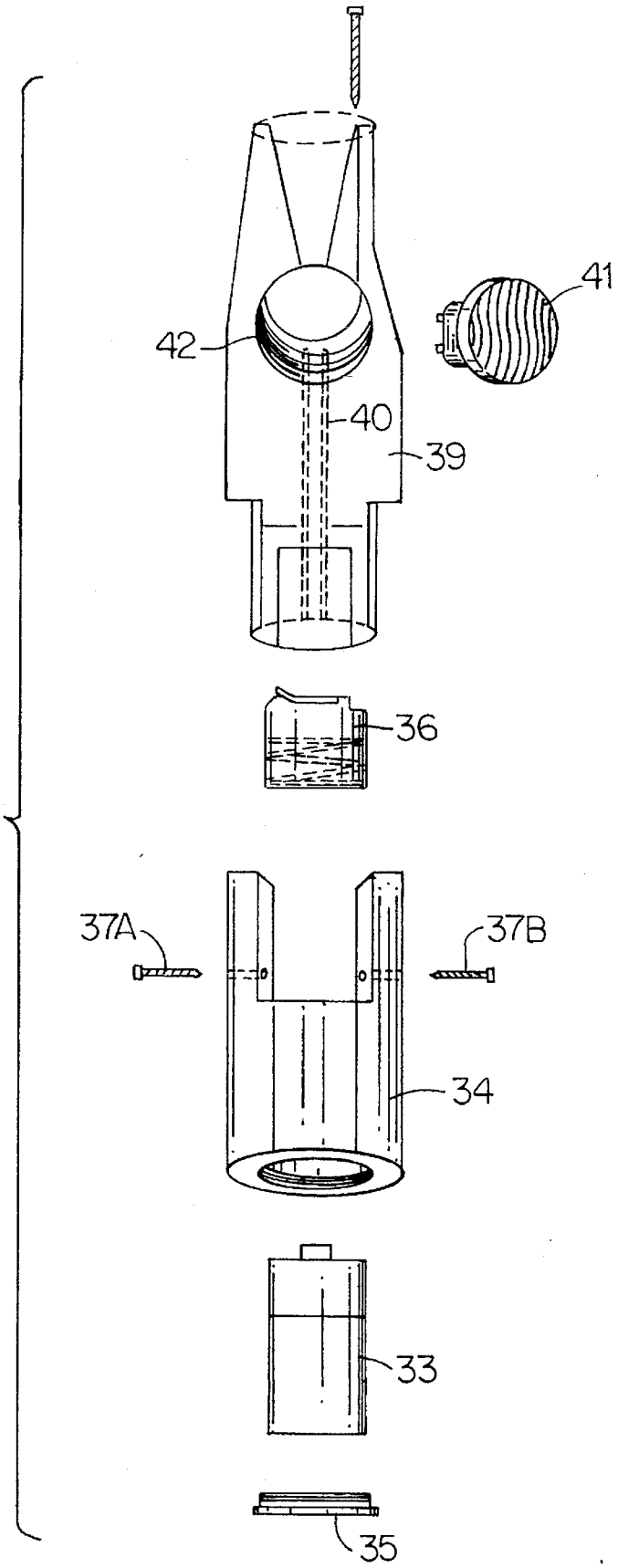
FIG. 4 is an exploded view of a battery subassembly insertable in the hollow grip element of the fore handgrip assembly.

The modification of the fore handgrip assembly 17 for installation of the laser sighting system of the invention will now be described. In its factory-made form the grip element 17 is hollow and has an opening at its lower end remote from the frame 22. FIG. 4 illustrates a subassembly of the laser sighting system of the invention which is inserted in the hollow grip element 17. That subassembly includes a direct current battery 33 received within a generally cylindrical battery housing 34 and held in place by a cap 35 threaded into the end of the housing 34. A contact cap 36 fits into the other end of the housing 34. Appropriate electrical wiring extends form the contact cap 36. Screws 37A and 37B hold together the housing 34, the cap 36 and a switch body 39 through which the electrical circuit extends as designated at 40. An on-off manually depressible button switch 41 is electrically connected in that circuit and is screwed into a threaded socket 42 in the switch body 39. When all of the parts shown in the exploded view 44 are assembled somewhat telescopically together they form a subassembly which is inserted in the hollow grip element 17 as shown in FIGS. 2 and 3.

A laser diode assembly 44 is located on the flange 32. The assembly 44 includes a block 45 secured by an appropirate fastener 46 to a seat specially machined in the flange 32. An open-ended housing portion 47 extends integrally from and is part of the block 45 and encircles a laser diode element 48. Between the rearward end of the laser diode element 48 and the block 45 is a compressible element such as a resilient O-ring 49. The diode element 48 is attached to the block 45 by screws 49 (shown in exploded removed position in FIG. 3) so as to bear against the resilient O-ring 49. This permits the screws 49 to be individually tightened and loosened so as to adjust the direction of the laser beam emitted from the diode element 48 in relation to the axis of the barrel 10. For sighting purposes this adjustment may take into account the range of the target and other factors. The previously mentioned electrical circuit means in the grip element 17 is continued in the frame as indicated in FIG. 3 by the solid line 50 connecting the battery 33 and the laser diode element 48. Wiring for that purpose is located in a groove in the frame 22 covered over by epoxy.

It will be apparent that the retrofitting of the detachable fore handgrip assembly 16 requires very little machining, essentially only slight modification of the grip element 17 to receive the button switch 41 and the machining of the flange 32 to receive the preassembled block 45 and its housing portion 47 and the diode element 48. As a consequence the detachable fore handgrip assembly 16 with the laser sighting system of the invention may be provided as a separate accessory for firearms such as the Heckler & Koch MP5K-PDW.

The scope of the invention is to be determined by the following claims rather than the foregoing description of a preferred embodiment.

We claim:

1. In a firearm which includes a barrel having a longitudinal axis and a forward muzzle, a trigger, a pistol handgrip transverse to the barrel axis rearward of said trigger, a detachable fore handgrip assembly forward of the trigger including a frame removably secured relative to the barrel and a hollow grip element extending from the frame transverse to the barrel axis, and a component forward of the hollow grip element separate from and below the barrel, a laser sighting system mounted entirely on said fore handgrip assembly comprising a) direct current battery means removably located within the hollow grip element with an opening at one end of the grip element remote from the frame for insertion of the battery means, b) a laser diode assembly mounted on said frame forward of the grip element for directing a laser beam alongside and at least substantially parallel to the barrel axis, c) the laser diode assembly comprising a laser diode element and an open-ended housing secured to said frame and encircling said diode element, d) electrical circuit means in the grip element and frame connecting the battery means and the laser diode element, e) said diode element being secured to the frame by adjustment screw means permitting angular adjustment in the direction of said laser beam in relation to the barrel axis, and f) an on-off manually depressible button switch on a forward portion of the grip element adjacent the frame and rearward of the diode assembly for selectively energizing the laser diode element.

2. A firearm according to claim 1 wherein said component is a guard flange on the frame forward of the hollow grip element and adjacent the muzzle for keeping the fingers of the user away from the muzzle, and the laser diode is mounted on the guard flange.

* * * * *